US011207890B2

(12) United States Patent
Bandoh

(10) Patent No.: US 11,207,890 B2
(45) Date of Patent: Dec. 28, 2021

(54) HEAD ARRAY, HEAD MODULE, DISCHARGE UNIT, AND LIQUID DISCHARGE APPARATUS

(71) Applicant: Ricoh Company, Ltd., Tokyo (JP)

(72) Inventor: Yoshinori Bandoh, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/030,593

(22) Filed: Sep. 24, 2020

(65) Prior Publication Data

US 2021/0094298 A1 Apr. 1, 2021

(30) Foreign Application Priority Data

Sep. 30, 2019 (JP) ..... JP2019-178230

(51) Int. Cl.
*B41J 2/155* (2006.01)
*B41J 2/14* (2006.01)

(52) U.S. Cl.
CPC ..... *B41J 2/155* (2013.01); *B41J 2/1433* (2013.01); *B41J 2002/14475* (2013.01)

(58) Field of Classification Search
CPC ..... B41J 2/155; B41J 2/1433
See application file for complete search history.

(56) References Cited

U.S. PATENT DOCUMENTS

2013/0050346 A1 2/2013 Takeuchi et al.
2020/0298566 A1* 9/2020 Sugioka ..... B41J 2/1433
2021/0114373 A1* 4/2021 Andoh ..... B41J 2/1433

FOREIGN PATENT DOCUMENTS

JP 2012-176560 9/2012

OTHER PUBLICATIONS

U.S. Appl. No. 16/819,607, filed Mar. 16, 2020 Yoshinori Bandoh.

* cited by examiner

*Primary Examiner* — Lamson D Nguyen
(74) *Attorney, Agent, or Firm* — XSENSUS LLP

(57) ABSTRACT

A head array includes heads arranged in a longitudinal direction at different positions shifted in a direction orthogonal to the longitudinal direction. Each head includes: pressure chambers communicating with nozzles; common supply channel tributaries communicating with the chambers; a common supply channel mainstream communicating with the common supply channel tributaries; common collection channel tributaries communicating with the chambers; a common collection channel mainstream communicating with the common collection channel tributaries; a supply port at one end of the common supply channel mainstream; and a collection port at one end of the common collection channel mainstream. The supply and collection ports are on a same side of each head in the longitudinal direction. A direction of flow of the liquid in each common supply channel tributary is opposite between the heads. A direction of flow of the liquid in each common collection channel tributary is opposite between the heads.

16 Claims, 15 Drawing Sheets

HEAD ARRAY, HEAD MODULE, DISCHARGE UNIT, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2019-178230, filed on Sep. 30, 2019, in the Japan Patent Office, the entire disclosure of which is hereby incorporated by reference herein.

BACKGROUND

Technical Field

Embodiments of the present disclosure relate to a head array, a head module, a discharge unit, and a liquid discharge apparatus.

Related Art

For example, a printing apparatus serving as a liquid discharge apparatus may include a head array in which a plurality of heads to discharge liquid are arranged in a staggered manner in a longitudinal direction of the head array.

There is known a liquid discharge apparatus includes a plurality of liquid discharge heads of a common liquid chamber circulation type in which liquid circulates in a common liquid chamber. The plurality of liquid discharge heads are arranged in a nozzle array direction in which nozzles are arrayed. The flow of liquid in the common liquid chamber from a liquid supply path to a liquid discharge path through the common liquid chamber is opposite to each other between adjacent liquid ejecting heads.

SUMMARY

In an aspect of the present disclosure, there is provided a head array that includes heads arranged in a longitudinal direction of the head array at different positions shifted in a direction orthogonal to the longitudinal direction. Each of the heads includes a plurality of pressure chambers, a plurality of common supply channel tributaries, a common supply channel mainstream, a plurality of common collection channel tributaries, a common collection channel mainstream, a supply port, and a collection port. The plurality of pressure chambers communicate with a plurality of nozzles configured to discharge liquid. The plurality of common supply channel tributaries communicate with the plurality of pressure chambers. The common supply channel mainstream communicates with the plurality of common supply channel tributaries. The plurality of common collection channel tributaries communicate with the plurality of pressure chambers. The common collection channel mainstream communicates with the plurality of common collection channel tributaries. The supply port is at one end of the common supply channel mainstream. The supply port is configured to supply the liquid from an outside. The collection port is at one end of the common collection channel mainstream. The collection port is configured to collect the liquid to the outside. The supply port and the collection port are on a same side of each of the heads in the longitudinal direction. A direction of flow of the liquid in each of the plurality of common supply channel tributaries is opposite between the heads. A direction of flow of the liquid in each of the plurality of common collection channel tributaries is opposite between the two heads.

In another aspect of the present disclosure, there is provided a head array. The head array includes a plurality of heads arranged in a longitudinal direction of the head array and arranged in an orthogonal direction of the head array. Each of the heads including a plurality of pressure chambers, a plurality of common supply channel tributaries, a common supply channel mainstream, a plurality of common collection channel tributaries, a common collection channel mainstream, a supply port, and a collection port. The plurality of pressure chambers are coupled to a plurality of nozzles configured to discharge liquid. The plurality of common supply channel tributaries are coupled to the pressure chambers. The common supply channel mainstream is coupled to the common supply channel tributaries. The plurality of common collection channel tributaries are coupled to the plurality of pressure chambers. The common collection channel mainstream is coupled to the common collection channel tributaries. The supply port is configured to supply the liquid from an outside. The collection port is configured to collect the liquid to the outside. The supply port and the collection port are on a same side of each of the heads in the longitudinal direction. A direction of flow of the liquid in each of the common supply channel tributaries is opposite between the heads. A direction of flow of the liquid in each of the common collection channel tributaries is opposite between the heads.

In still another aspect of the present disclosure, there is provided a head module comprising the head array according to any of the above-described aspects.

In still yet another aspect of the present disclosure, there is provided a discharge unit including a plurality of head modules arranged side by side. Each of the plurality of head modules includes the head array according to any of the above-described aspects.

In still yet further another aspect of the present disclosure, there is provided a liquid discharge apparatus including the discharge unit.

In still yet further another aspect of the present disclosure, there is provided a liquid discharge apparatus including the head module.

In still further another aspect of the present disclosure, there is provided a liquid discharge apparatus including the head array according to any of the above-described aspects.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
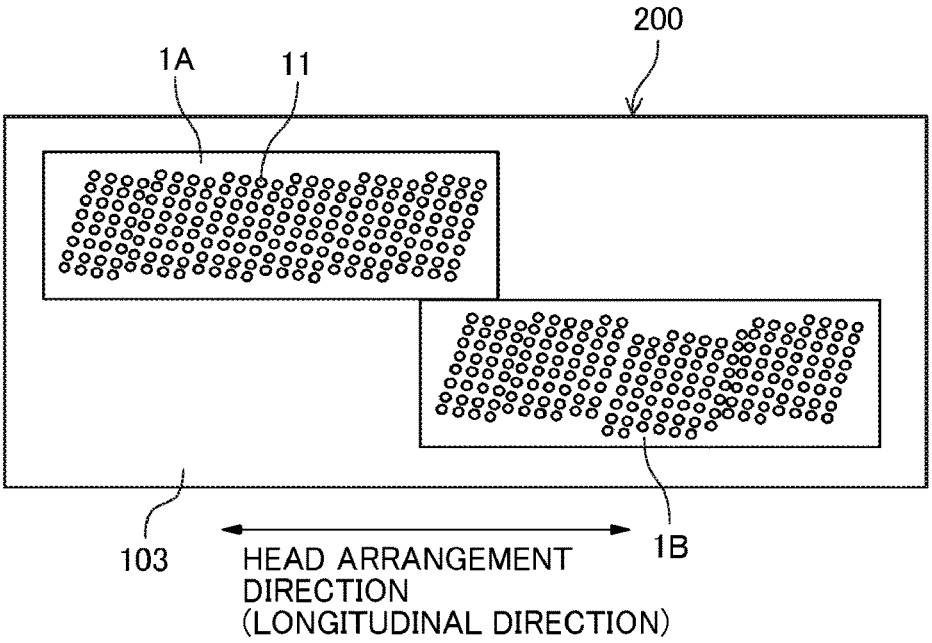
FIG. 1 is a plan view of a head array according to a first embodiment of the present disclosure as viewed from a nozzle surface side.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Below, embodiments of the present disclosure are described with reference to the attached drawings. A first embodiment of the present disclosure is described with reference to FIG. 1. FIG. 1 is a plan view of a head array according to the first embodiment as viewed from a nozzle surface side.

A head array 200 according to the present embodiment includes a plurality of heads 1 (two heads 1A and 1B in the present embodiment) arranged in a longitudinal direction on the base substrate 103. The positions of the heads 1A and 1B are shifted from each other in a direction orthogonal to the longitudinal direction. That is, the plurality of heads 1 are arranged in a staggered manner.

In other words, "the positions are shifted in the direction orthogonal to the longitudinal direction" means that the two heads are shifted so as not to completely overlap each other in the longitudinal direction, or that the two heads are partially adjacent to each other in the direction orthogonal to the longitudinal direction.

In other words, "arranged in the longitudinal direction" means that the centers of the heads in the longitudinal direction are arranged at a distance from each other in the longitudinal direction or arranged in a direction along the longitudinal direction.

Figure 2:
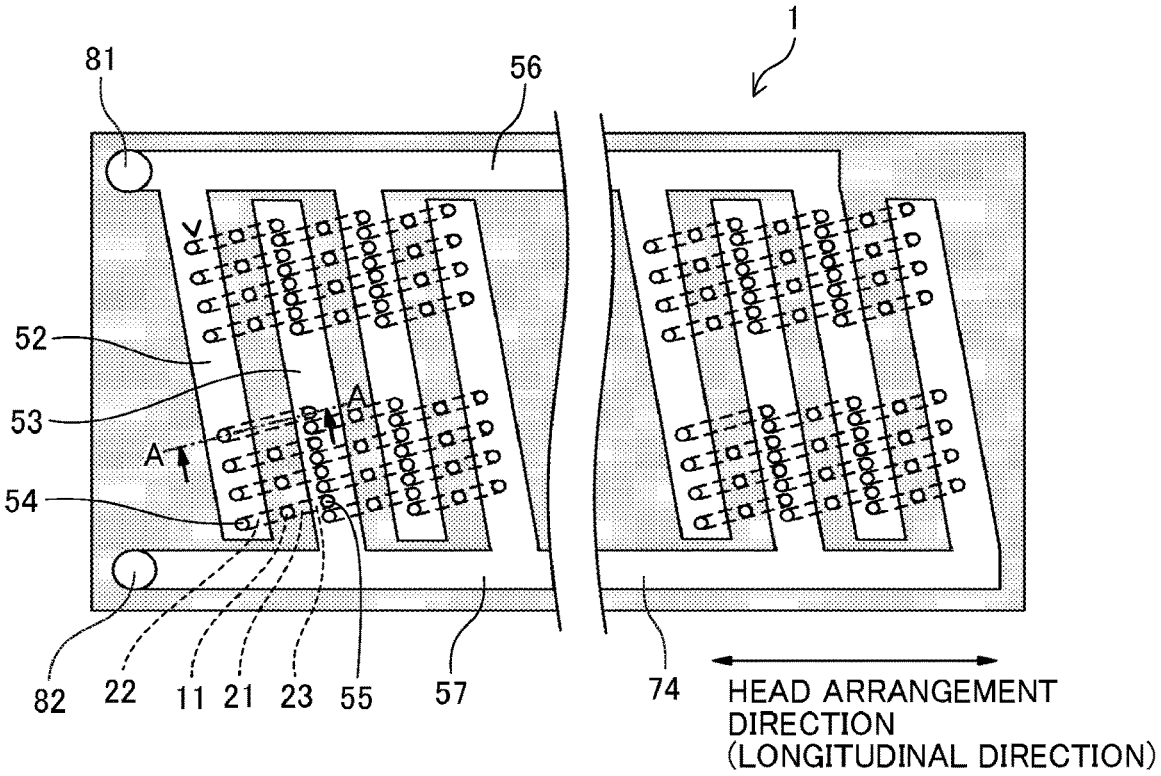
FIG. 2 is a plan view illustrating a channel arrangement configuration of an example of a head of the head array according to the first embodiment.
Figure 3:
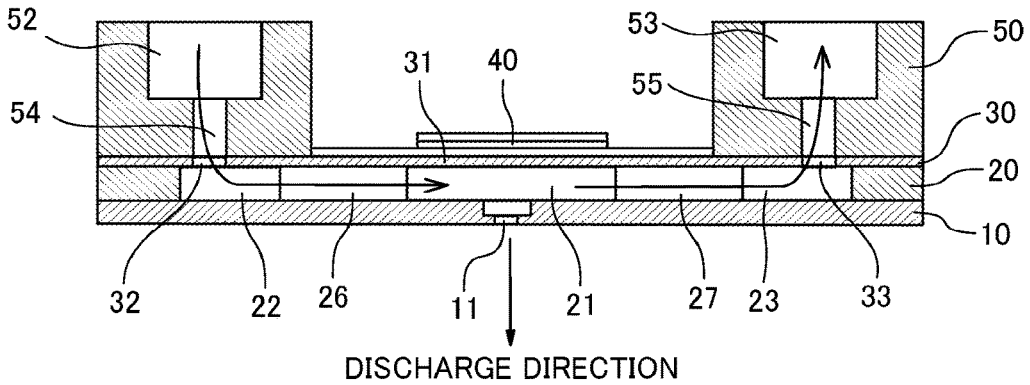
FIG. 3 is a cross-sectional view of the head taken along line A-A of FIG. 2.

Next, an example of the head of the head array is described with reference to FIGS. 2 and 3. FIG. 2 is a plan view of a channel arrangement of the head. FIG. 3 is a sectional view taken along line A-A of FIG. 2.

The head 1 includes, for example, a nozzle plate 10, a channel plate (or individual channel substrate) 20, a diaphragm substrate 30, a piezoelectric element 40, and a common channel tributary substrate 50.

The nozzle plate 10 includes a plurality of nozzles 11 to discharge liquid. The plurality of nozzles 11 are arranged in a two-dimensional matrix.

The individual channel substrate 20 forms a plurality of pressure chambers (individual liquid chambers) 21 that communicate with the plurality of nozzles 11, a plurality of individual supply channels 22 that communicate with the plurality of pressure chambers 21, and a plurality of individual collection channels 23 that communicate with the plurality of pressure chambers 21. The individual supply channel 22 includes a supply-side fluid restrictor 26, and the individual collection channel 23 includes a collection-side fluid restrictor 27.

The diaphragm substrate 30 forms a diaphragm 31 that is a deformable wall of the pressure chamber 21. The diaphragm 31 is integrated with a piezoelectric element 40. Further, the diaphragm substrate 30 includes a supply-side opening 32 that communicates with the individual supply channel 22 and a collection-side opening 33 that communicates with the individual collection channel 23. The piezoelectric element 40 is a pressure generator that deforms the diaphragm 31 to pressurize liquid in the pressure chamber 21.

The common channel tributary substrate 50 includes a plurality of common supply channel tributaries 52 that communicate with two or more individual supply channels 22 and a plurality of common collection channel tributaries 53 that communicate with two or more individual collection channels 23. The plurality of common supply channel tributaries 52 and the plurality of common collection channel tributaries 53 are alternately arranged adjacent to each other.

The common channel tributary substrate 50 includes: a supply port 54 that communicates the supply-side opening 32 of the individual supply channel 22 with the common supply channel tributary 52; and a collection port 55 that communicates the collection-side opening 33 of the individual collection channel 23 with the common collection channel tributary 53.

Further, the common channel tributary substrate 50 includes at least one common supply channel mainstream 56 that communicates with the plurality of common supply channel tributaries 52 and at least one common collection channel mainstream 57 that communicates with the plurality of common collection channel tributaries 53.

The common supply channel mainstream 56 and the plurality of common supply channel tributaries 52 constitute a common supply channel. The common collection channel mainstream 57 and the plurality of common collection channel tributaries 53 constitute a common collection channel.

A supply port 81 to supply liquid from the outside communicates with one end of the common supply channel mainstream 56. A collection port 82 to collect liquid to the outside communicates with one end of the common collection channel mainstream 57.

Figure 4:
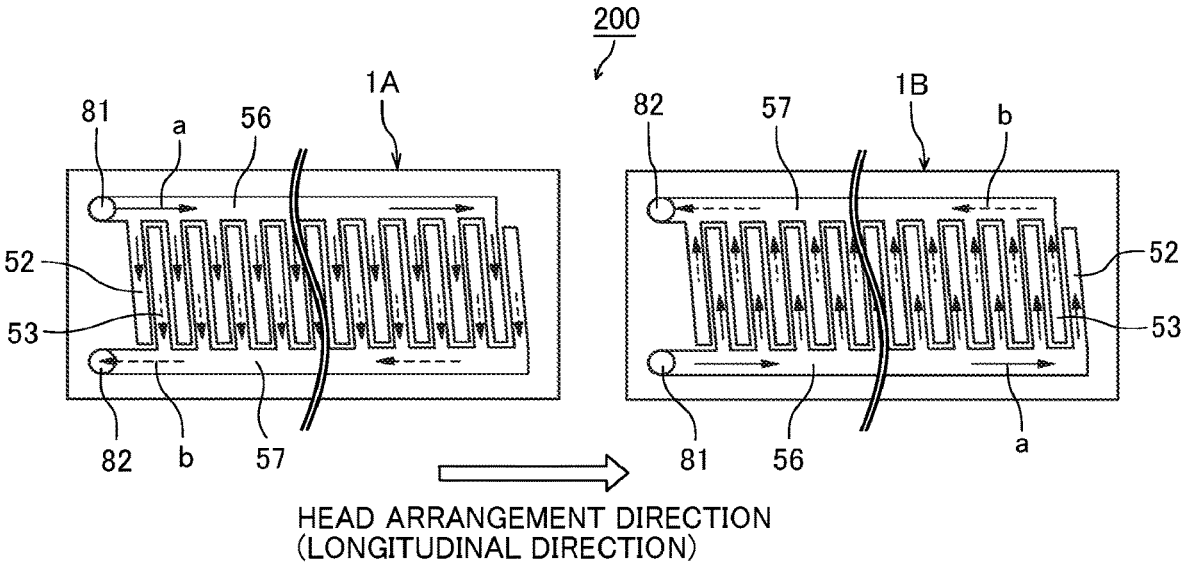
FIG. 4 is a plan view illustrating the arrangement of two heads and the flow of liquid in the first embodiment.

Next, the arrangement of the two heads according to the present embodiment is described with reference to FIG. 4. FIG. 4 is a plan view of the arrangement of the two heads and the flow of liquid. In FIG. 4, the two heads are illustrated side by side on the same line.

In each of the heads 1A and 1B, the supply port 81 and the collection port 82 are disposed on the same end in the longitudinal direction of each head.

The supply port 81 and the collection port 82 of the head 1A and the supply port 81 and the collection port 82 of the head 1B are located on the same side in a head arrangement direction that is also the longitudinal direction of the head 1. That is, the supply port 81 and the collection port 82 of the head 1A and the supply port 81 and the collection port 82 of the head 1B are located on the left side in FIG. 4.

The supply port 81 and the collection port 82 of the head 1A and the supply port 81 and the collection port 82 of the head 1B are located on opposite sides in a direction orthogonal to the head arrangement direction. That is, in FIG. 4, the supply port 81 of the head 1A is positioned on the upper side, and the supply port 81 of the head 1B is positioned on the lower side.

In the head array 200 configured as described above, the liquid supplied from the supply port 81 of the head 1 flows along the common supply channel mainstream 56 as indicated by a direction of solid-line arrow a (hereinafter, referred to as "a direction") and is branched and flows into each of the common supply channel tributaries 52.

The liquid that is not discharged from the nozzle 11 flows from the common supply channel tributary 52 to the common collection channel tributary 53 through the individual supply channel 22, the pressure chamber 21, and the individual collection channel 23.

The liquid that has flowed into the common collection channel tributaries 53 flow through the respective common collection channel tributaries 53 toward the common collection channel mainstream 57, merge in the common collection channel mainstream 57, and flow toward the collection port 82, as indicated by a direction of broken line arrow b (hereinafter referred to as the "b direction").

Accordingly, the direction of the flow of the liquid in the common supply channel mainstream 56 in the head 1A and the direction of the flow of the liquid in the common supply channel mainstream 56 in the head 1B are opposite to each other in the head arrangement direction.

Similarly, the direction of the flow of the liquid in the common collection channel mainstream 57 in the head 1A and the direction of the flow of the liquid in the common collection channel mainstream 57 in the head 1B are opposite to each other in the head arrangement direction.

The direction of the flow of the liquid in the common supply channel tributary 52 in the head 1A and the direction of the flow of the liquid in the common supply channel tributary 52 in the head 1B are opposite to each other in a direction intersecting the head arrangement direction, that is, the longitudinal direction of the common supply channel tributary 52.

Similarly, the direction of the flow of the liquid in the common collection channel tributary 53 in the head 1A and the direction of the flow of the liquid in the common collection channel tributary 53 in the head 1B are opposite to each other in the direction intersecting the head arrangement direction, that is, the longitudinal direction of the common collection channel tributary 53.

Figure 5:
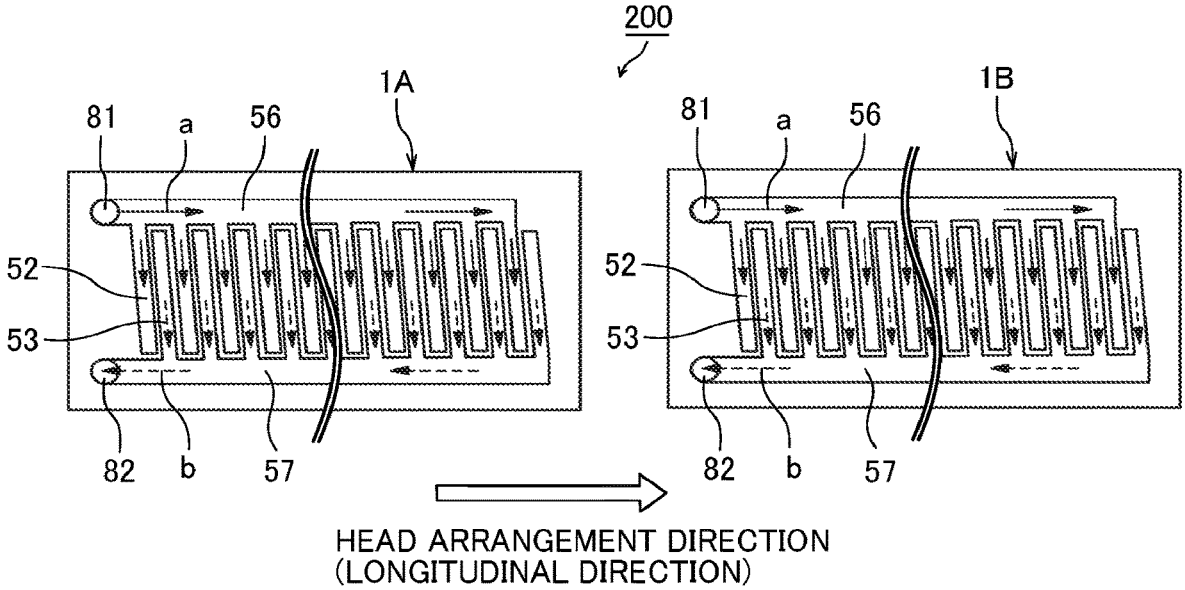
FIG. 5 is a plan view illustrating the arrangement of two heads and the flow of liquid in Comparative Example 1.

Here, Comparative Example 1 is described with reference to FIG. 5. FIG. 5 is a plan view of the arrangement of two heads and the flow of liquid in Comparative Example 1. In FIG. 5, the two heads are illustrated side by side on the same line.

In Comparative Example 1, the supply port 81 and the collection port 82 of the head 1A and the supply port 81 and the collection port 82 of the head 1B are located on the same side in a head arrangement direction that is also the longitudinal direction of the head 1. That is, the supply port 81 and the collection port 82 of the head 1A and the supply port 81 and the collection port 82 of the head 1B are located on the left side in FIG. 5.

The supply port 81 and the collection port 82 of the head 1A and the supply port 81 and the collection port 82 of the head 1B are located on the same side in a direction orthogonal to the head arrangement direction. That is, in FIG. 4, the supply port 81 of the head 1A is located on the upper side, and the supply port 81 of the head 1B is located on the upper side.

In Comparative Example 1, the direction of the flow of the liquid in the common supply channel mainstream 56 in the head 1A and the direction of the flow of the liquid in the common supply channel mainstream 56 in the head 1B are the same direction in the head arrangement direction. Similarly, the direction of the flow of the liquid in the common collection channel mainstream 57 in the head 1A and the direction of the flow of the liquid in the common collection channel mainstream 57 in the head 1B are the same direction in a nozzle array direction.

In addition, the direction of the flow of the liquid in the common supply channel tributary 52 in the head 1A and the direction of the flow of the liquid in the common supply channel tributary 52 in the head 1B are the same direction in the direction intersecting the head arrangement direction, that is, the longitudinal direction of the common supply channel tributary 52.

Similarly, the direction of the flow of the liquid in the common collection channel tributary 53 in the head 1A and the direction of the flow of the liquid in the common collection channel tributary 53 in the head 1B are the same direction in the direction intersecting the head arrangement direction, that is, the longitudinal direction of the common collection channel tributary 53.

Figure 6:
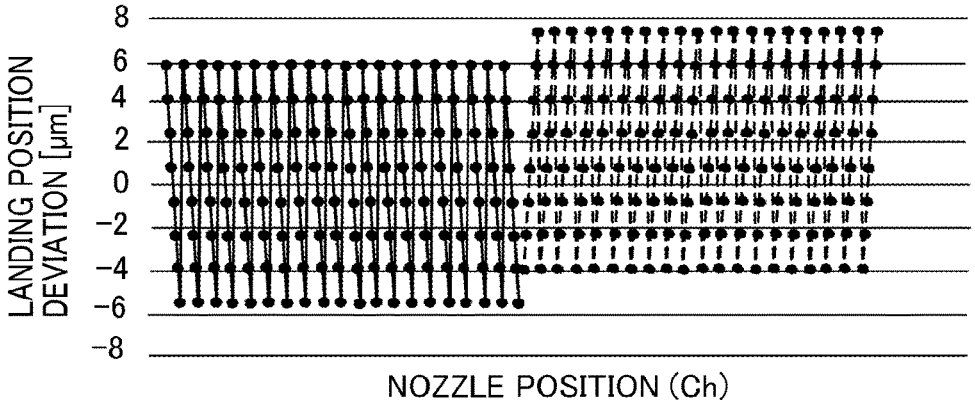
FIG. 6 is an illustration of an example of landing position deviation at a joint of heads in the first embodiment.
Figure 7:
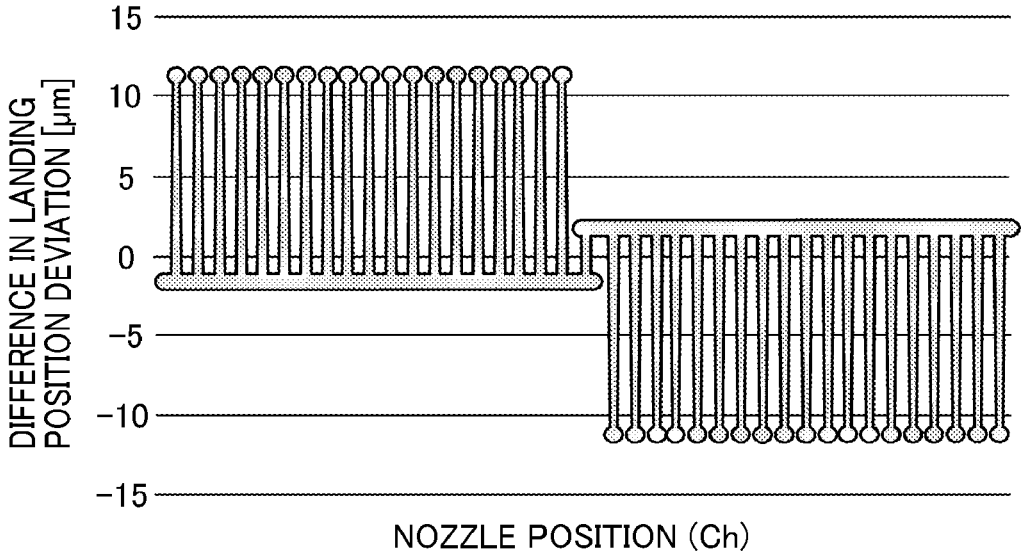
FIG. 7 is an illustration of an example of the difference in landing position deviation amount between consecutive channels (nozzles) in the vicinity of the joint of the heads of FIG. 6.
Figure 8:
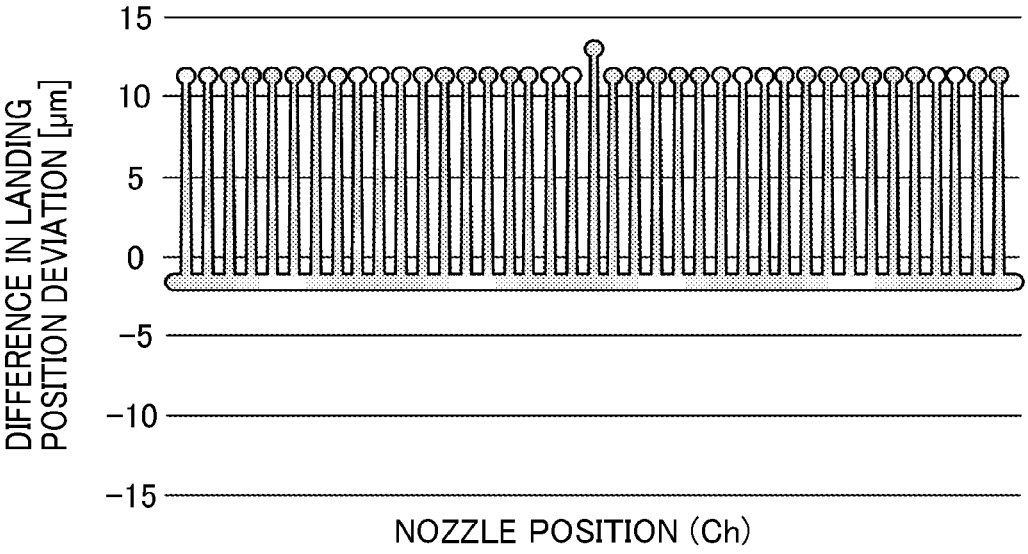
FIG. 8 is an illustration of an example of the difference in landing position deviation amount between consecutive channels (or nozzles) in the vicinity of a joint of heads in Comparative Example 1.

Next, the operation and effect of the present embodiment are described with reference to FIGS. 6 to 8 in comparison with Comparative Example 1. FIG. 6 is an illustration of an example of landing position deviation at a joint of heads in the present embodiment. FIG. 7 is an illustration of an example of difference in landing position deviation amount between consecutive channels (or nozzles) in the vicinity of the joint of the heads. FIG. 8 is an illustration of an example of the difference in landing position deviation amount between consecutive channels (or nozzles) in the vicinity of a joint of heads in Comparative Example 1.

In the head 1, the pressure applied to the meniscus of each nozzle 11 is affected by the pressure loss in the common supply channel mainstream 56, the pressure loss in the common supply channel tributary 52, the pressure loss in the common collection channel tributary 53, and the pressure loss in the common collection channel mainstream 57.

At this time, in a case where the speed of the ejected droplet changes with respect to the pressure applied to the meniscus, when the liquid is circulated, a difference in the landing position occurs due to a difference in the droplet speed Vj caused by the pressure.

In the heads 1A and 1B constituting the head array 200, the supply port 81 and the collection port 82 are disposed on the same one end side in the longitudinal direction, and the directions of the liquid flows in the common supply channel mainstream 56 and the common collection channel mainstream 57 are opposite to each other. Therefore, the difference in meniscus pressure between the common supply channel mainstream 56 and the common collection channel mainstream 57 in the longitudinal direction can be reduced.

On the other hand, since the flow direction of the liquid in the common supply channel tributary 52 and the flow direction of the liquid in the common collection channel tributary 53 are the same, the meniscus pressure becomes lower toward the downstream side. Accordingly, a difference in droplet velocity Vj occurs, thus causing a landing position deviation.

Hence, in the present embodiment, the supply port 81 and the collection port 82 of the head 1A and the supply port 81 and the collection port 82 of the head 1B are positioned on opposite sides in the direction orthogonal to the head arrangement direction.

Therefore, as described above, the direction of the flow of the liquid in the common supply channel mainstream 56 and the common collection channel mainstream 57 in the head 1A and the direction of the flow of the liquid in the common supply channel mainstream 56 and the common collection channel mainstream 57 in the head 1B are opposite to each other in the head arrangement direction.

Similarly, the direction of the flow of the liquid in the common supply channel tributary 52 and the common collection channel tributary 53 in the head 1A and the direction of the flow of the liquid in the common supply channel tributary 52 and the common collection channel tributary 53 in the head 1B are opposite to each other in the direction intersecting the head arrangement direction.

Similarly, the direction of the flow of the liquid in the common collection channel tributary 53 in the head 1A and the direction of the flow of the liquid in the common collection channel tributary 53 in the head 1B are opposite to each other in the direction intersecting the head arrangement direction.

At this time, the landing position deviation at the joint between the heads 1A and 1B is, for example, as illustrated in FIG. 6. In each of the heads 1A and 1B, landing position deviations occur due to the arrangement of the nozzles (or the arrangement of the channels) of the common supply channel tributary 52 and the common collection channel tributary 53. The landing position deviations are shifted by the difference between the menisci of the heads 1A and 1B In such a case, the difference in the landing position deviation amount between the nozzles (channels) continuous in the head arrangement direction is, for example, as illustrated in FIG. 7. It can be seen from FIG. 7 that a deviation corresponding to the difference between the menisci of the heads 1A and 1B occurs in the vicinity of the joint of the heads 1A and 1B.

On the other hand, when the direction of the flow of the liquid is the same as in Comparative Example 1, the difference in the landing position deviation amount between the consecutive nozzles (channels) is, for example, as illustrated in FIG. 8. The difference in the landing position deviation amount of the head of Comparative Example 1 is larger than the difference in the landing position deviation amount of the heads 1A and 1B according to the present embodiment.

As described above, in the present embodiment, the direction of the flow of the liquid in the common supply channel tributary 52 and the common collection channel tributary 53 in the head 1A and the direction of the flow of the liquid in the common supply channel tributary 52 and the common collection channel tributary 53 in the head 1B are opposite to each other in the direction intersecting the head arrangement direction. Such a configuration can reduce the difference in the landing position deviation amount at the joint of the heads.

Figure 9:
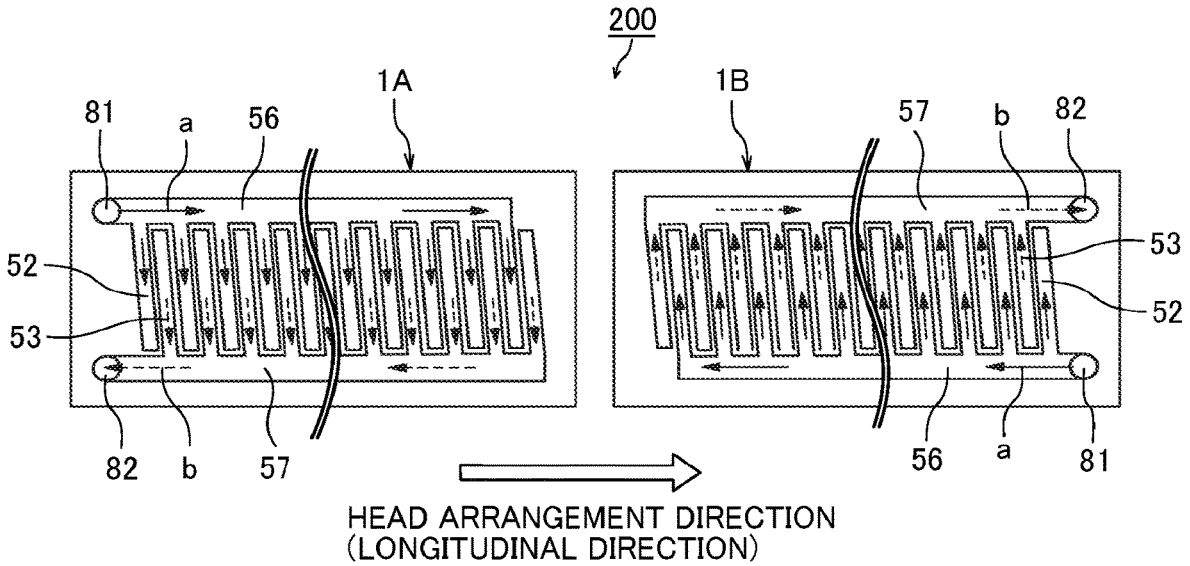
FIG. 9 is a plan view illustrating the arrangement of two heads and the flow of liquid in a second embodiment of the present disclosure.

Next, a second embodiment of the present disclosure is described with reference to FIG. 9. FIG. 9 is a plan view of the arrangement of two heads and the flow of liquid in the second embodiment. In FIG. 9, the two heads are illustrated side by side on the same line.

In each of the heads 1A and 1B, the supply port 81 and the collection port 82 are disposed on the same end in the longitudinal direction of each head.

The supply port 81 and the collection port 82 of the head 1A and the supply port 81 and the collection port 82 of the head 1B are located on opposite sides in the head arrangement direction (which is also the longitudinal direction of the head 1).

The supply port 81 and the collection port 82 of the head 1A and the supply port 81 and the collection port 82 of the head 1B are located on opposite sides in a direction orthogonal to the head arrangement direction.

In the head array 200 configured as described above, the direction of the flow of the liquid in the common supply channel mainstream 56 in the head 1A and the direction of the flow of the liquid in the common supply channel mainstream 56 in the head 1B are opposite to each other in the head arrangement direction.

Similarly, the direction of the flow of the liquid in the common collection channel mainstream 57 in the head 1A and the direction of the flow of the liquid in the common collection channel mainstream 57 in the head 1B are opposite to each other in the head arrangement direction.

The direction of the flow of the liquid in the common supply channel tributary 52 in the head 1A and the direction of the flow of the liquid in the common supply channel tributary 52 in the head 1B are opposite to each other in a direction intersecting the head arrangement direction, that is, the longitudinal direction of the common supply channel tributary 52.

Similarly, the direction of the flow of the liquid in the common collection channel tributary 53 in the head 1A and the direction of the flow of the liquid in the common collection channel tributary 53 in the head 1B are opposite to each other in the direction intersecting the head arrangement direction, that is, the longitudinal direction of the common collection channel tributary 53.

Similarly to the first embodiment, such a configuration can reduce the difference in the landing position deviation amount at the joint of the heads.

Since the heads 1A and 1B are rotated by 180 degrees, the same heads can be arranged.

Figure 10:
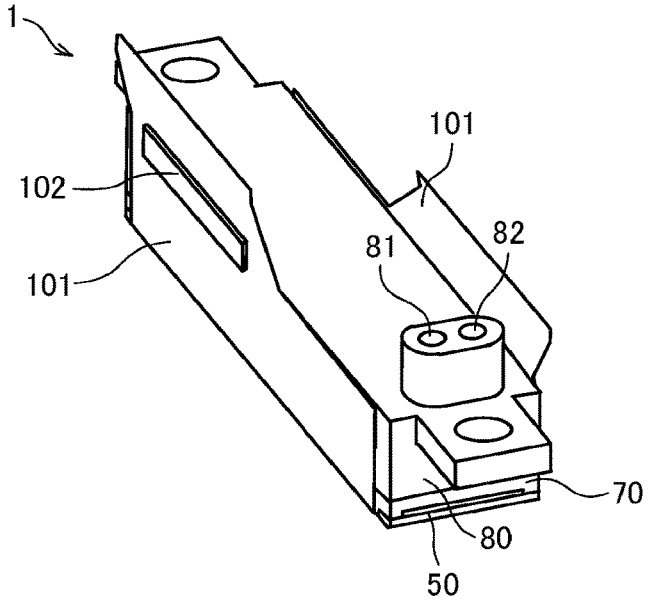
FIG. 10 is an external perspective view of a head of a head array according to a third embodiment of the present disclosure.
Figure 11:
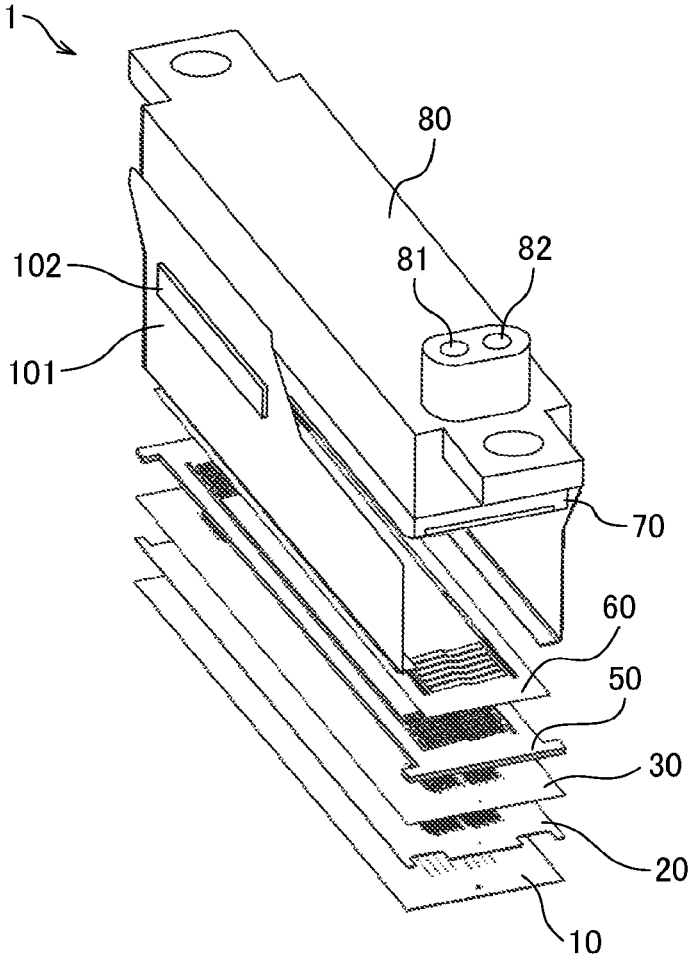
FIG. 11 is an exploded perspective view of the head of FIG. 10.
Figure 12:
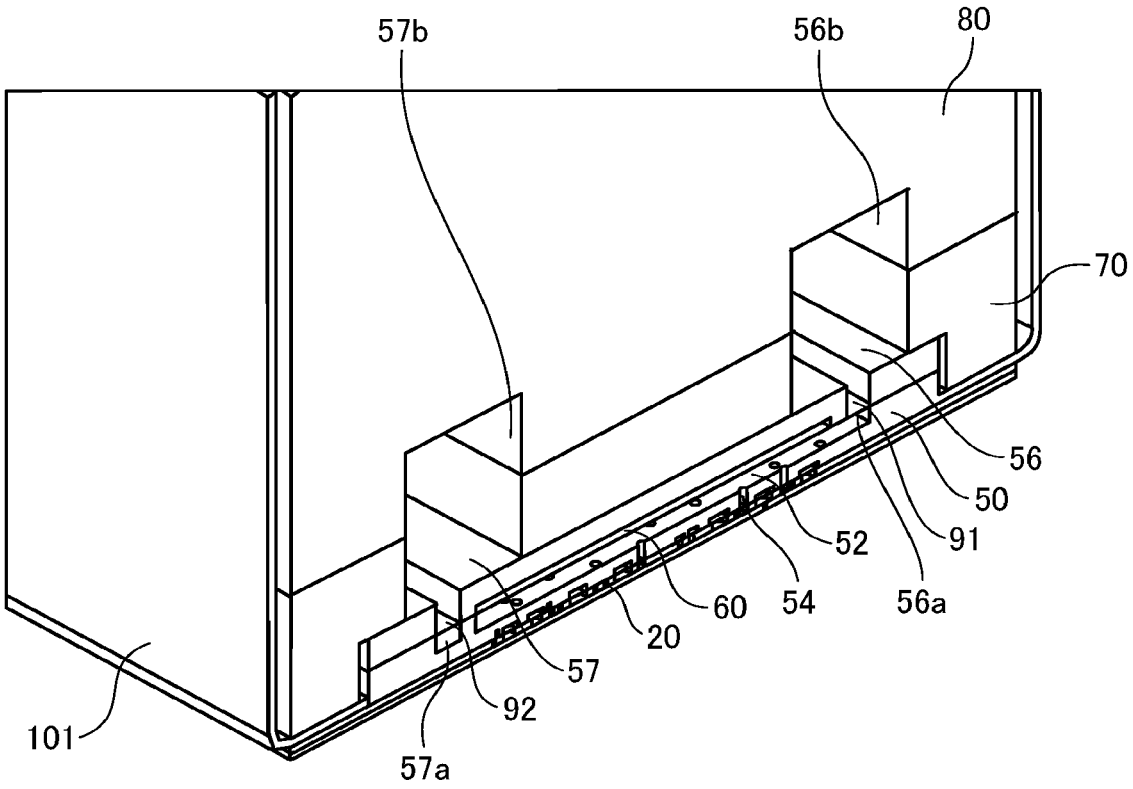
FIG. 12 is a cross-sectional perspective view of the head of FIG. 10.
Figure 13:
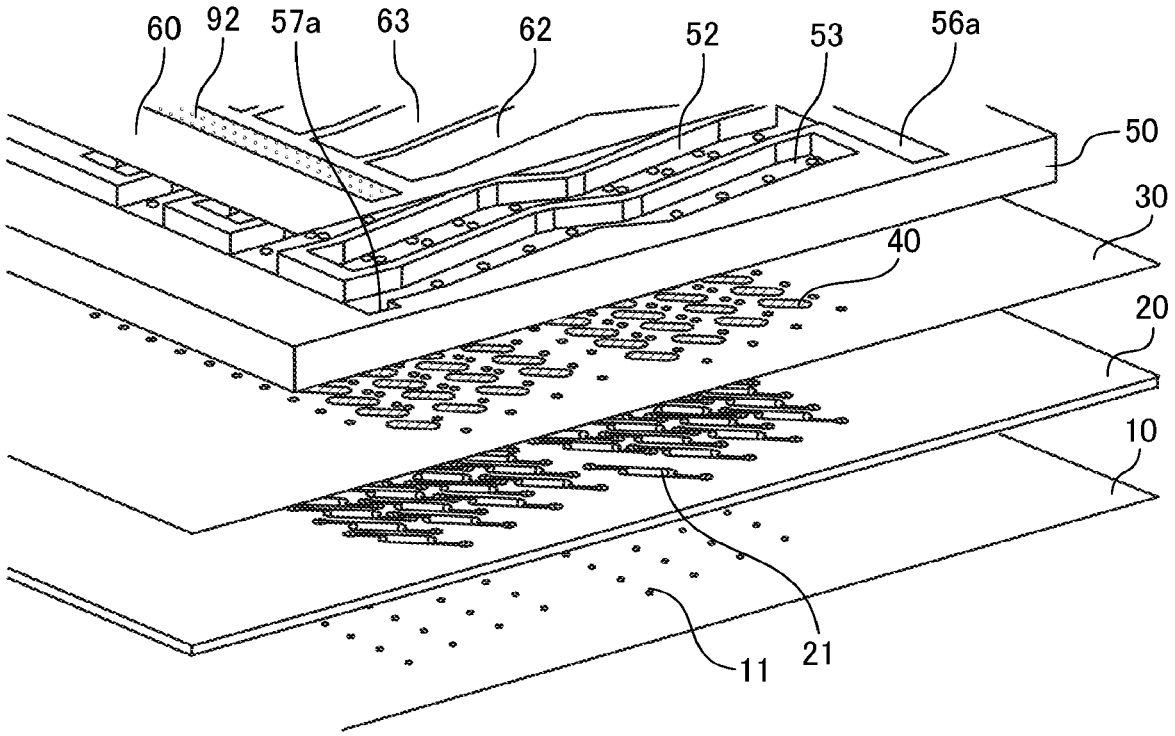
FIG. 13 is an exploded perspective view of the head of FIG. 12 excluding a frame substrate.
Figure 14:
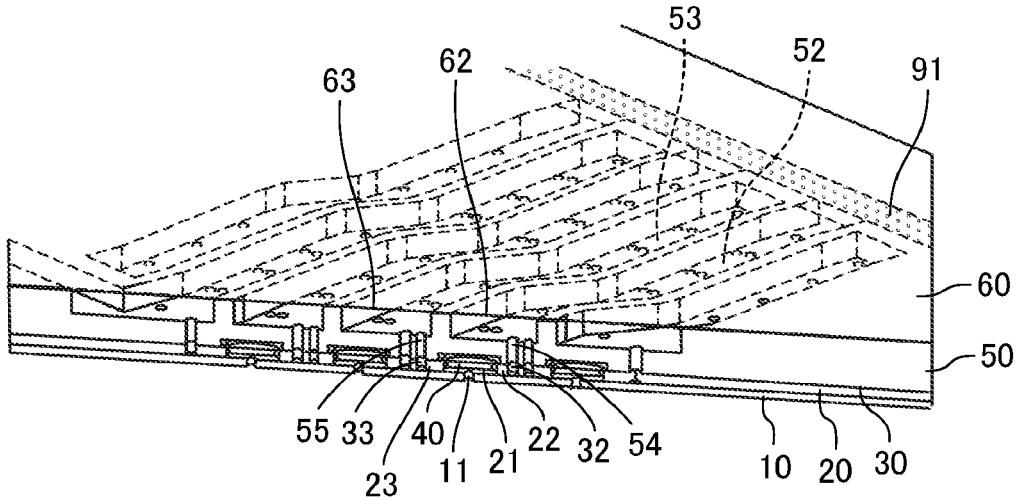
FIG. 14 is a cross-sectional perspective view of channels in the head of FIG. 13.
Figure 15:
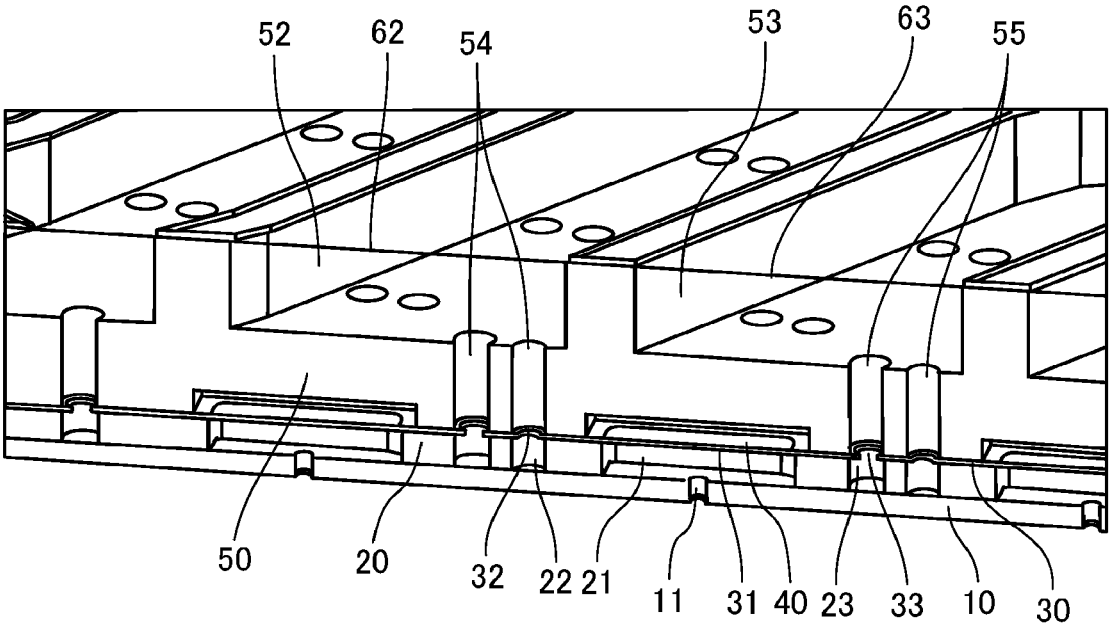
FIG. 15 is an enlarged cross-sectional perspective view of the channels of FIG. 14.
Figure 16:
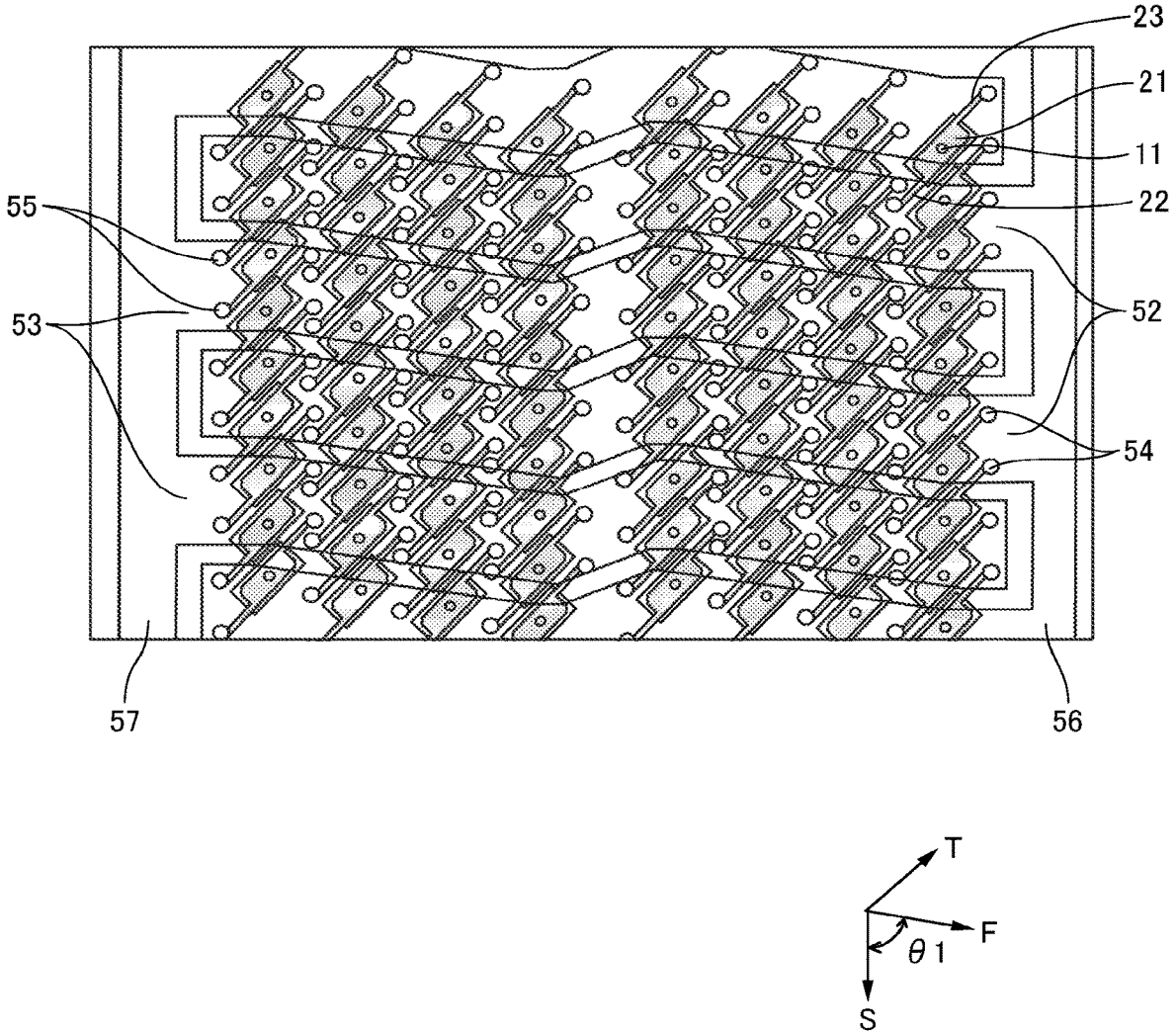
FIG. 16 is a plan view of the channels of FIG. 14.

Referring to FIGS. 10 to 16, a description is given of a third embodiment of the present disclosure. FIG. 10 is an external perspective view of a head constituting a head array according to the third embodiment. FIG. 11 is an exploded perspective view of the head of FIG. 10. FIG. 12 is a sectional perspective view of the head of FIG. 10. FIG. 13 is an exploded perspective view of the head of FIG. 10 except for a frame substrate. FIG. 14 is a sectional perspective view of channels in the head of FIG. 13. FIG. 15 is an enlarged sectional perspective view of the channels of FIG. 14. FIG. 16 is a plan view of the channels in the head of FIG. 13.

The head 1 includes, for example, a nozzle plate 10, a channel plate (or individual channel substrate) 20, a diaphragm substrate 30, a common channel substrate (here, a common channel tributary substrate) 50, a damper substrate 60, a common channel mainstream substrate 70, a frame substrate 80, and a wiring board (or flexible wiring member) 101. A head driver (or a driver integrated circuit (IC)) 102 is mounted on the wiring board 101.

The nozzle plate 10 includes a plurality of nozzles 11 to discharge liquid. The nozzles 11 are arranged in a two-dimensional matrix and, for example, as illustrated in FIG. 16, arranged side by side in three directions, i.e., a first direction F, a second direction S, and a third direction T.

The individual channel substrate 20 forms a plurality of pressure chambers (individual liquid chambers) 21 that communicate with the plurality of nozzles 11, a plurality of individual supply channels 22 that communicate with the plurality of pressure chambers 21, and a plurality of individual collection channels 23 that communicate with the plurality of pressure chambers 21.

The diaphragm substrate 30 forms a diaphragm 31 that is a deformable wall of the pressure chamber 21. The diaphragm 31 is integrated with a piezoelectric element 40. Further, the diaphragm substrate 30 includes a supply-side opening 32 that communicates with the individual supply channel 22 and a collection-side opening 33 that communicates with the individual collection channel 23. The piezoelectric element 40 is a pressure generator that deforms the diaphragm 31 to pressurize liquid in the pressure chamber 21.

The individual channel substrate 20 and the diaphragm substrate 30 are not limited to be separate members. For example, the individual channel substrate 20 and the diaphragm substrate 30 may be integrated as a single member using an SOI (Silicon on Insulator) substrate. That is, an SOI substrate in which a silicon oxide film, a silicon layer, and a silicon oxide film are formed in this order on a silicon substrate can be used. The silicon substrate serves as the individual channel substrate 20, and the silicon oxide film, the silicon layer, and the silicon oxide film constitute the diaphragm 31. In such a configuration, the layer structure of the silicon oxide film, the silicon layer, and the silicon oxide film of the SOI substrate constitutes the diaphragm substrate 30. Thus, the diaphragm substrate 30 may be composed of materials formed as films on the surface of the individual channel substrate 20.

The common channel tributary substrate 50 alternately forms a plurality of common supply channel tributaries 52 communicating with two or more individual supply channels 22 and a plurality of common collection channel tributaries 53 communicating with two or more individual collection channels 23 in the second direction S of the nozzles 11.

The common channel tributary substrate 50 forms a through hole serving as a supply port 54 that communicates the supply-side opening 32 of the individual supply channel 22 with the common supply channel tributary 52, and another through hole serving as a collection port 55 that communicates the collection-side opening 33 of the individual collection channel 23 with the common collection channel tributary 53.

Further, the common channel tributary substrate 50 forms a part 56*a* of the one or more common supply channel mainstreams 56 communicating with the plurality of common supply channel tributaries 52 and a part 57*a* of one or more common collection channel mainstreams 57 communicating with the plurality of common collection channel tributaries 53.

The damper substrate 60 includes a supply-side damper 62 that faces (or opposes) the supply port 54 of the common supply channel tributary 52, and a collection-side damper 63 that faces (or opposes) the collection port 55 of the common collection channel tributary 53.

Here, the common supply channel tributary 52 and the common collection channel tributary 53 are configured by sealing groove portions alternately arranged in the common channel tributary substrate 50, which is the same member, with the damper substrate 60 forming a deformable wall surface. The damper substrate 60 is preferably made of a metal thin film or inorganic thin film that is resistant to organic solvents. The thickness of the damper substrate 60 is preferably 10 μm or less.

The damper substrate 60 forms a supply-side filter portion 91 and a collection-side filter portion 92.

The common channel mainstream substrate 70 forms a part 56*b* of the common supply channel mainstream 56 communicating with the plurality of common supply channel tributaries 52 and a part 57*b* of the common collection channel mainstream 57 communicating with the plurality of common collection channel tributaries 53.

A part 56*b* of the common supply channel mainstream 56 and a part 57*b* of the common collection channel mainstream 57 are formed in the frame substrate 80. The part 56*b* of the common supply channel mainstream 56 communicates with the supply port 81 provided in the frame substrate 80. The part 57*b* of the common collection channel mainstream 57 communicates with the collection port 82 provided in the frame substrate 80.

The plurality of heads 1 configured as described above are arranged in the same manner as in the first embodiment and the second embodiment to form a head array, thus allowing a reduction in the difference in landing position deviation amount at the joint of the heads.

Figure 17:
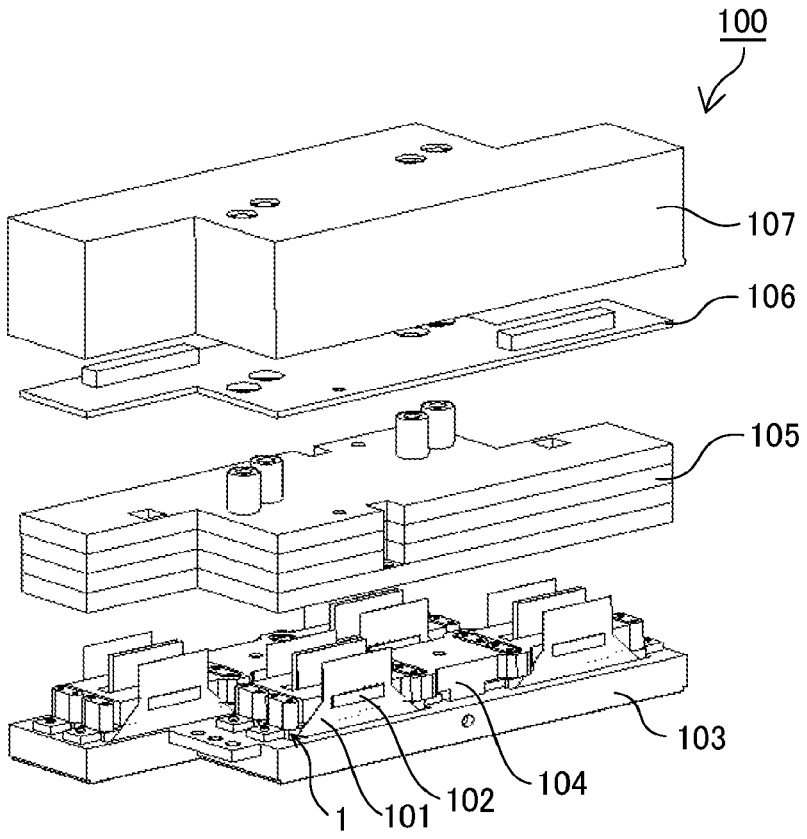
FIG. 17 is an exploded perspective view of a head module according to an embodiment of the present disclosure.
Figure 18:
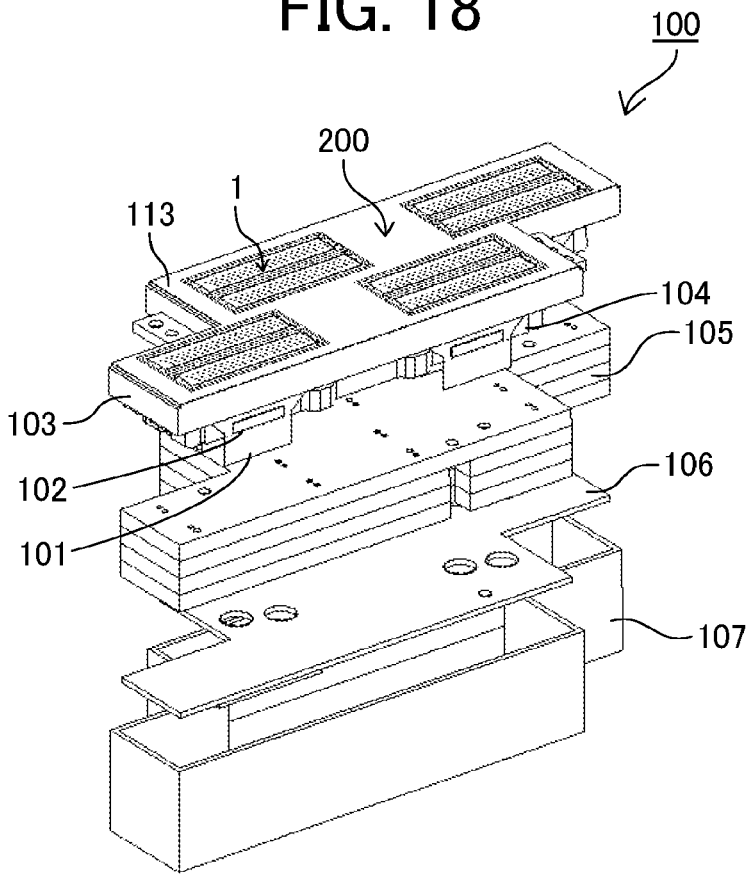
FIG. 18 is an exploded perspective view of the head module of FIG. 17 as viewed from a nozzle surface side.

Next, a head module according to an embodiment of the present disclosure is described with reference to FIGS. 17 and 18. FIG. 17 is an exploded perspective view of the head module. FIG. 18 is an exploded perspective view of the head module as viewed from the nozzle surface side.

A head module 100 according to the present embodiment includes a plurality of heads 1 that discharge liquid, a base substrate 103 that holds the plurality of heads 1, and a cover 113 that serves as a nozzle cover of the plurality of heads 1.

In addition, the head module 100 includes a heat dissipation member 104, a manifold 105 forming channels to supply liquid to the plurality of heads 1, a printed circuit board (PCB) 106 connected to wiring boards (or flexible wiring members) 101, and a module case 107.

In the head module 100, a head array 200 includes two sets of eight heads 1 are arranged in a staggered manner in the longitudinal direction (at different positions shifted in a direction orthogonal to the longitudinal direction).

Figure 19:
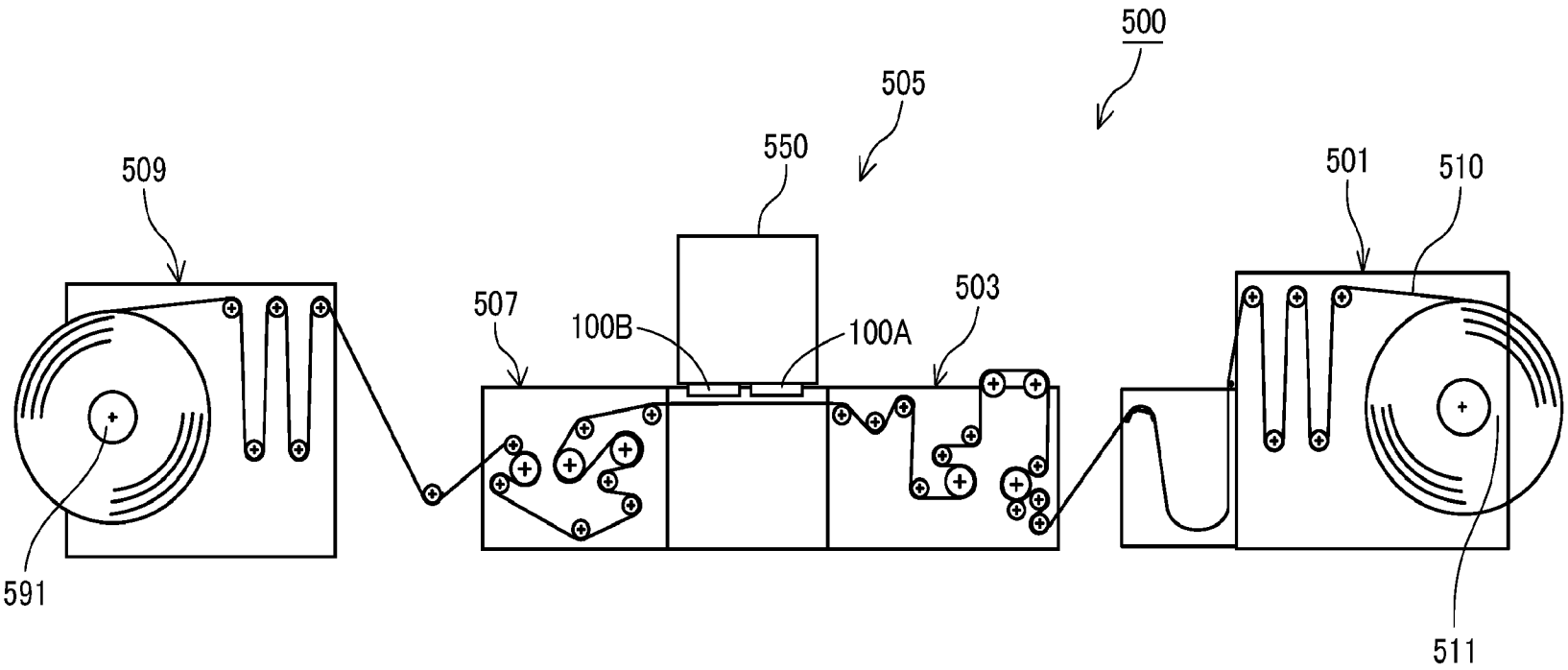
FIG. 19 is a schematic side view of a liquid discharge apparatus according to an embodiment of the present disclosure.
Figure 20:
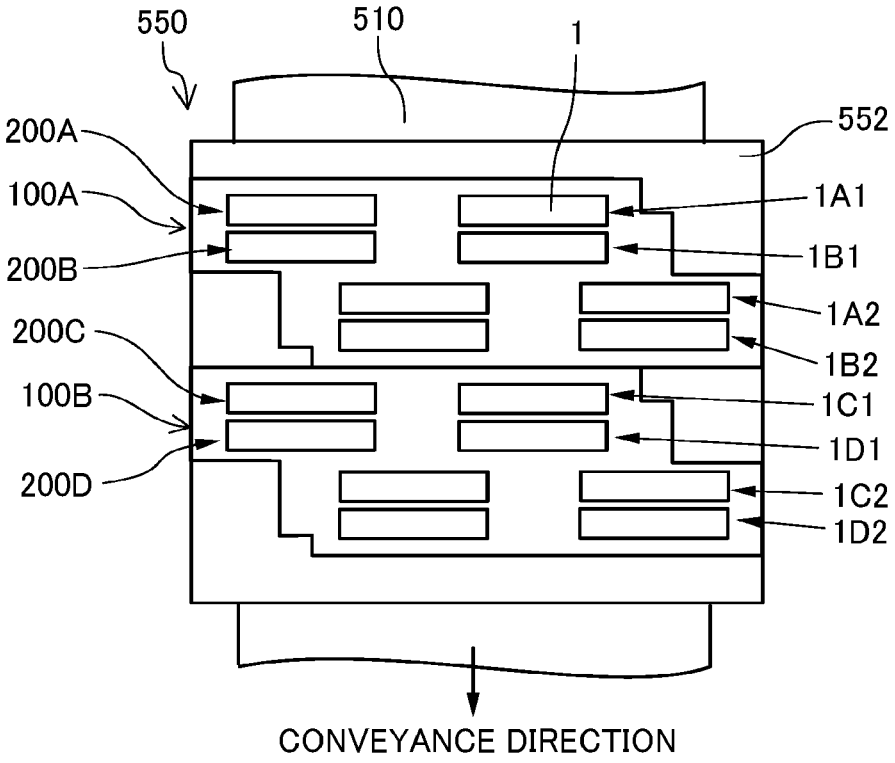
FIG. 20 is a plan view of an example of a discharge unit of the liquid discharge apparatus according to an embodiment of the present disclosure.

Next, a liquid discharge apparatus according to an embodiment of the present disclosure is described with reference to FIGS. 19 and 20. FIG. 19 is a schematic side view of the liquid discharge apparatus. FIG. 20 is a plan view of an example of a discharge unit of the liquid discharge apparatus of FIG. 19.

A printing apparatus 500 serving as the liquid discharge apparatus serving as the liquid discharge apparatus according to the present embodiment includes: a feeder 501; a guide conveyor 503; a printer 505; a drier 507; a carrier 509; and the like. The feeder 501 feeds a continuous medium 510 inward. The guide conveyor 503 guides and conveys the continuous medium 510 fed inward from the feeder 501. The printer 505 performs printing by discharging liquid onto the conveyed continuous medium 510 to form an image. The drier 507 dries the continuous medium 510 with the image formed. The carrier 509 feeds the dried continuous medium 510 outward.

The continuous medium 510 is sent out from an original winding roller 511 of the feeder 501, is guided and conveyed by rollers of the feeder 501, the guide conveyor 503, the drier 507, and the carrier 509, and is wound up by a wind-up roller 591 of the carrier 509.

In the printer 505, the continuous medium 510 is conveyed on a conveyance guide 559 so as to face a discharge unit 550, and an image is printed with the liquid discharged from the discharge unit 550.

The discharge unit 550 includes two head modules 100A and 100B according to the present embodiment on a common base 552.

In such a case, head rows 1A1 and 1A2 of the head module 100A constitute a head array 200A that discharges liquid of a common color, and similarly, head rows 1B1 and 1B2 constitute a head array 200B that discharges liquid of a common color.

In addition, head rows 1C1 and 1C2 of the head module 100B constitute a head array 200C that discharges liquid of a common color, and head rows 1D1 and 1D2 constitute a head array 200D that discharges liquid of a common color.

Figure 21:
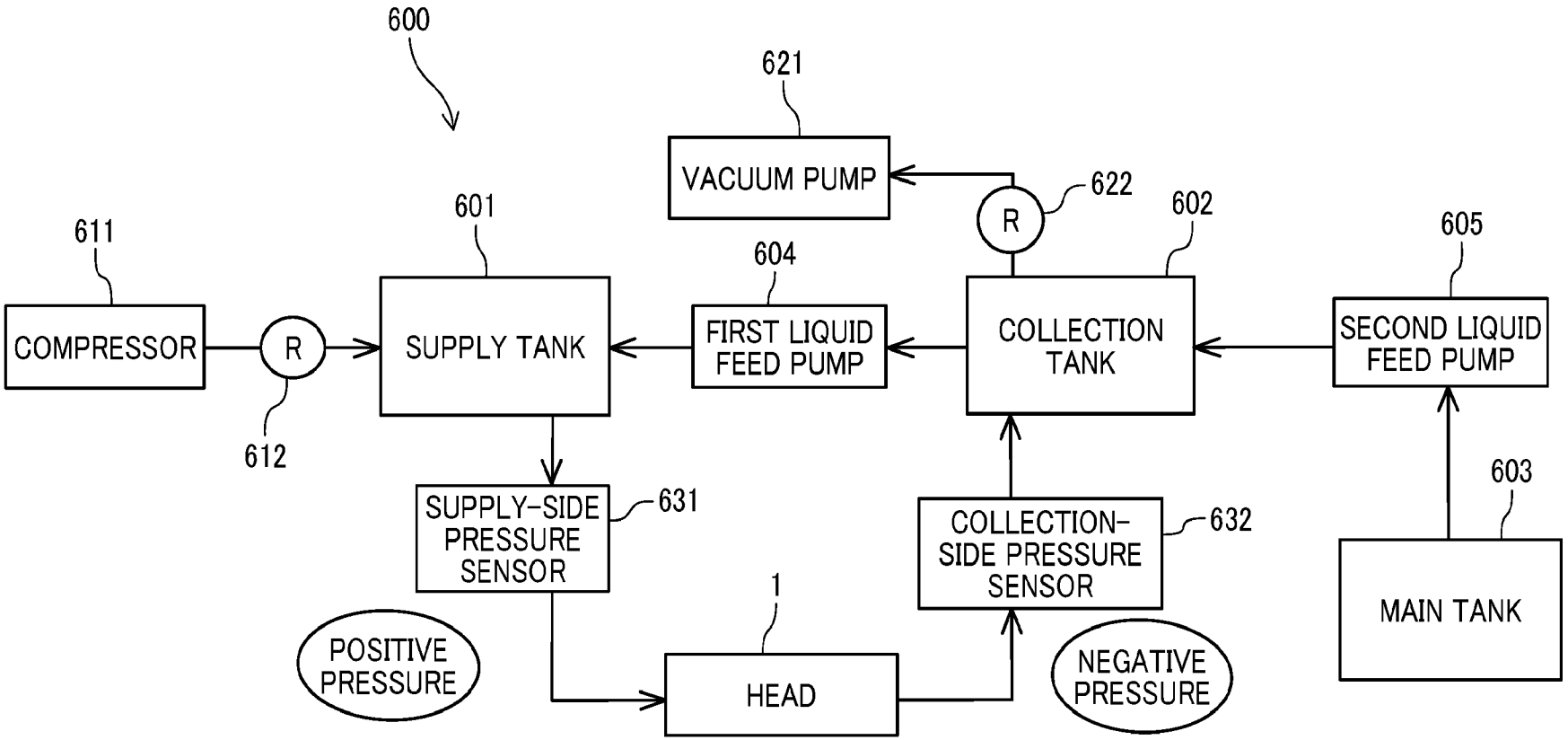
FIG. 21 is a block diagram of an example of a liquid circulation device according to an embodiment of the present disclosure.

Next, a description is given below of an example of a liquid circulation device employed in the liquid discharge apparatus according to an embodiment of the present disclosure, with reference to FIG. 21. FIG. 21 is a block diagram of the liquid circulation device according to the present embodiment. Although only one head is illustrated in FIG. 21, in a case in which a plurality of heads are arranged, a supply-side liquid path and a collection-side liquid path, respectively, are connected to the supply side and the collection side of the plurality of heads via a manifold or the like.

The liquid circulation device 600 includes, for example, a supply tank 601, a collection tank 602, a main tank 603, a first liquid feed pump 604, a second liquid feed pump 605, a compressor 611, a regulator 612, a vacuum pump 621, a regulator 622, a supply-side pressure sensor 631, and a collection-side pressure sensor 632.

The compressor 611 and the vacuum pump 621 together generate a pressure difference between the supply tank 601 and the collection tank 602.

The supply-side pressure sensor 631 is disposed between the supply tank 601 and the head 1 and connected to a supply-side liquid path connected to the supply port 81 of the head 1. The collection-side pressure sensor 632 is disposed between the head 1 and the collection tank 602 and connected to a collection-side liquid path connected to the collection port 82 of the head 1.

One end of the collection tank 602 is connected to the supply tank 601 via the first liquid feed pump 604, and the other end of the collection tank 602 is connected to the main tank 603 via the second liquid feed pump 605.

Accordingly, the liquid flows into the head 1 from the supply tank 601 through the supply port 81, is collected to the collection tank 602 from the collection port 82, and is sent from the collection tank 602 to the supply tank 601 by the first liquid feed pump 604, thereby forming a circulation path through which the liquid circulates.

Here, the compressor 611 is connected to the supply tank 601 and is controlled so that a predetermined positive pressure is detected by the supply-side pressure sensor 631. On the other hand, the vacuum pump 621 is connected to the collection tank 602 and is controlled so that a predetermined negative pressure is detected by the collection-side pressure sensor 632.

Thus, the negative pressure of the meniscus can be kept constant while the liquid is circulated through the head 1.

When the liquid is discharged from the nozzles 11 of the head 1, the amount of liquid in the supply tank 601 and the collection tank 602 decreases. Therefore, the liquid is appropriately replenished from the main tank 603 to the collection tank 602 using the second liquid feed pump 605.

The timing of liquid replenishment from the main tank 603 to the collection tank 602 can be controlled based on, for example, the detection result of a liquid level sensor provided in the collection tank 602. In such a case, for example, liquid replenishment may be performed when the liquid level of the liquid in the collection tank 602 falls below a predetermined height.

In the present disclosure, discharged liquid is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling. Examples of the liquid include a solution, a suspension, or an emulsion that contains, for example, a solvent such as water and an organic solvent, a colorant such as dye and pigment, a functional material such as a polymerizable compound, a resin, and a surfactant, a biocompatible material such as deoxyribonucleic acid (DNA), amino acid, protein, and calcium, or an edible material such as a natural colorant. Such a solution, a suspension, and an emulsion are used for, e.g., inkjet ink, a surface treatment solution, a liquid for forming components of an electronic element and a light-emitting element or a resist pattern of an electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a heating resistor (element), and an electrostatic actuator including a diaphragm and opposed electrodes.

The term "liquid discharge apparatus" used herein also represents an apparatus including a head array, a head module, or a discharge device to discharge liquid by driving the head. The liquid discharge apparatus may be, for example, an apparatus capable of discharging liquid to a material to which liquid can adhere or an apparatus to discharge liquid toward gas or into liquid.

The liquid discharge apparatus can include at least one of devices for feeding, conveying, and ejecting a material to which liquid can adhere. The liquid discharge apparatus can further include at least one of a pretreatment apparatus and a post-treatment apparatus.

The liquid discharge apparatus may be, for example, an image forming apparatus to form an image on a sheet by discharging ink, or a three-dimensional fabricating apparatus (solid-object fabricating apparatus) to discharge a fabrication liquid to a powder layer in which powder material is formed in layers, so as to form a three-dimensional fabrication object (solid fabrication object).

The liquid discharge apparatus is not limited to an apparatus to discharge liquid to visualize meaningful images, such as letters or figures. For example, the liquid discharge apparatus can produce patterns like geometric design and three-dimensional images.

The above-described term "material on which liquid can be adhered" represents a material on which liquid is at least temporarily adhered, a material on which liquid is adhered and fixed, or a material into which liquid is adhered to permeate. Examples of "material to which liquid can adhere" include paper sheets, recording media such as recording sheet, recording sheets, film, and cloth; electronic components such as electronic substrates and piezoelectric elements; and media such as powder layers, organ models, and testing cells. The term "material to which liquid can adhere" includes any material to which liquid adheres, unless particularly limited.

Examples of the "material to which liquid can be adhered" include any materials on which liquid can be adhered even temporarily, such as paper, thread, fiber, fabric, leather, metal, plastic, glass, wood, and ceramic.

The liquid discharge apparatus may be an apparatus to relatively move a liquid discharge head and a material on which liquid can be adhered. However, the liquid discharge apparatus is not limited to such an apparatus. Specific examples of such an apparatus include a serial-type apparatus in which a head is movable and a line-type apparatus in which a liquid discharge head is unmovable.

Examples of the "liquid discharge apparatus" further include a treatment liquid coating apparatus to discharge a treatment liquid to a sheet to coat the treatment liquid on a sheet surface to reform the sheet surface and an injection granulation apparatus in which a composition liquid including raw materials dispersed in a solution is discharged through nozzles to granulate fine particles of the raw materials.

The terms "image formation", "recording", "printing", "image printing", and "fabricating" used herein may be used synonymously with each other.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The invention claimed is:

1. A head array, comprising:

a plurality of heads arranged in a longitudinal direction of the head array at different positions shifted in a direction orthogonal to the longitudinal direction, each of the heads including:

a plurality of pressure chambers communicating with a plurality of nozzles configured to discharge liquid;

a plurality of common supply channel tributaries communicating with the plurality of pressure chambers;

a common supply channel mainstream communicating with the plurality of common supply channel tributaries;

a plurality of common collection channel tributaries communicating with the plurality of pressure chambers;

a common collection channel mainstream communicating with the plurality of common collection channel tributaries;

a supply port at one end of the common supply channel mainstream, the supply port being configured to supply the liquid from an outside; and a collection port at one end of the common collection channel mainstream, the collection port being configured to collect the liquid to the outside, wherein the supply port and the collection port are on a same side of each of the heads in the longitudinal direction, a direction of flow of the liquid in each of the plurality of common supply channel tributaries is opposite between the heads, and a direction of flow of the liquid in each of the plurality of common collection channel tributaries is opposite between the heads.

2. The head array according to claim 1, wherein the supply port and the collection port of one of the heads and the supply port and the collection port of the other of the heads are on a same side in the longitudinal direction, and wherein the supply port and the collection port of the one of the heads and the supply port and the collection port of the other of the heads are on opposite sides in the direction orthogonal to the longitudinal direction.

3. The head array according to claim 1, wherein the supply port and the collection port of one of the heads and the supply port and the collection port of the other of the heads are on opposite sides in the longitudinal direction, and wherein the supply port and the collection port of the one of the heads and the supply port and the collection port of the other of the heads are on a same side in the direction orthogonal to the longitudinal direction.

4. A head module comprising the head array according to claim 1.

5. A liquid discharge apparatus comprising the head module according to claim 4.

6. A discharge unit comprising a plurality of head modules arranged side by side, each of the plurality of head modules including the head array according to claim 1.

7. A liquid discharge apparatus comprising the discharge unit according to claim 6.

8. A liquid discharge apparatus comprising the head array according to claim 1.

9. A head array, comprising:

a plurality of heads arranged in a longitudinal direction of the head array, and arranged in an orthogonal direction of the head array, each of the heads including:

a plurality of pressure chambers coupled to a plurality of nozzles configured to discharge liquid;

a plurality of common supply channel tributaries coupled to the pressure chambers;

a common supply channel mainstream coupled to the common supply channel tributaries;

a plurality of common collection channel tributaries coupled to the plurality of pressure chambers;

a common collection channel mainstream coupled to the common collection channel tributaries;

a supply port configured to supply the liquid from an outside; and a collection port configured to collect the liquid to the outside, wherein the supply port and the collection port are on a same side of each of the heads in the longitudinal direction, a direction of flow of the liquid in each of the common supply channel tributaries is opposite between the heads, and a direction of flow of the liquid in each of the common collection channel tributaries is opposite between the heads.

10. The head array according to claim 9, wherein the supply port and the collection port of one of the heads and the supply port and the collection port of the other of the heads are on a same side in the longitudinal direction, and wherein the supply port and the collection port of the one of the heads and the supply port and the collection port of the other of the heads are on opposite sides in the orthogonal direction.

11. The head array according to claim 9, wherein the supply port and the collection port of one of the heads and the supply port and the collection port of the other of the heads are on opposite sides in the longitudinal direction, and wherein the supply port and the collection port of the one of the heads and the supply port and the collection port of the other of the heads are on a same side in the orthogonal direction.

12. A head module comprising the head array according to claim 9.

13. A liquid discharge apparatus comprising the head module according to claim 12.

14. A discharge unit comprising a plurality of head modules arranged side by side, each of the plurality of head modules including the head array according to claim 9.

15. A liquid discharge apparatus comprising the discharge unit according to claim 14.

16. A liquid discharge apparatus comprising the head array according to claim 9.

* * * * *